US010809667B2

(12) United States Patent
Olwal

(10) Patent No.: US 10,809,667 B2
(45) Date of Patent: Oct. 20, 2020

(54) BIDIRECTIONAL AND EXPRESSIVE INTERACTION IN A HYBRID SMART WATCH

(71) Applicant: Google LLC, Mountain View, CA (US)

(72) Inventor: Alex Olwal, San Francisco, CA (US)

(73) Assignee: Google LLC, Mountain View, CA (US)

( * ) Notice: Subject to any disclaimer, the term of this patent is extended or adjusted under 35 U.S.C. 154(b) by 273 days.

(21) Appl. No.: 15/960,808

(22) Filed: Apr. 24, 2018

(65) Prior Publication Data

US 2019/0324404 A1 Oct. 24, 2019

(51) Int. Cl.
*G04B 45/00* (2006.01)
*G04B 19/04* (2006.01)

(52) U.S. Cl.
CPC ..... *G04B 45/0061* (2013.01); *G04B 19/04* (2013.01)

(58) Field of Classification Search
CPC ..... G04B 45/00; G04B 19/04; G04B 45/0061
See application file for complete search history.

(56) References Cited

U.S. PATENT DOCUMENTS 5,329,501 A * 7/1994 Meister ..... G04G 21/04 368/10
5,528,559 A 6/1996 Lucas
6,700,836 B1 3/2004 Satodate et al.
9,348,320 B1 * 5/2016 Defazio ..... G04G 11/00
10,088,809 B2 * 10/2018 Lee ..... G04G 9/00
10,146,188 B2 * 12/2018 Katzer ..... G04B 19/04
10,222,750 B2 * 3/2019 Bang ..... G04B 19/04
2003/0165086 A1 * 9/2003 Brewer ..... G02F 1/133536 368/82
2016/0306328 A1 * 10/2016 Ko ..... G04C 17/00
2017/0068217 A1 3/2017 Chen et al.
(Continued)

FOREIGN PATENT DOCUMENTS

WO 2016141393 A1 9/2016

OTHER PUBLICATIONS

Non-emissive display—google.com—Mar. 16, 2020.*
(Continued)

*Primary Examiner* — Sean Kayes
(74) *Attorney, Agent, or Firm* — Lerner, David, Littenberg, Krumholz & Mentlik, LLP

(57) ABSTRACT

Aspects of the disclosure provide a hybrid smartwatch that incorporates digital technology with an analog timepiece in a wristwatch form factor. A digital display layer of a non-emissive material is configured to present notices, data, content and other information. An analog display layer includes one or more hands of the timepiece, and overlies the digital display layer. The hands may be controlled by a processor through micro-stepper motors or other actuators. Physical motion of the hands provides expressivity, for instance via visual mechatronic effects. This may include buzzing, clapping, providing stylized visual features, hiding or minimizing information, and revealing information. The information presented on the digital display layer is presented concurrently with the hand movement, in a manner that complements the hand motion. This provides a rich, symbiotic dual-display layer arrangement that enhances the capabilities of the digital and analog display layers.

20 Claims, 11 Drawing Sheets

(56) References Cited

U.S. PATENT DOCUMENTS

| | | | | |
|---|---|---|---|---|
| 2017/0082983 | A1 | 3/2017 | Katzer et al. | |
| 2017/0269555 | A1* | 9/2017 | Poguntke | G04G 5/04 |

OTHER PUBLICATIONS

Liu et al., "Characterizing Smartwatch Usage in the Wild", MobiSys, Jun. 19-23, 2017, 14 pages.
Palladino, Valentina, "Misfit Phase proves hybrid smartwatches could replace basic activity trackers", Ars Technica, Jan. 15, 2017, 14 pages.
Palladino, Valentina, "Revisiting Fossil hybrid smartwatches: From curiousity to practicality", Ars Technica, Dec. 20, 2017, 6 pages.
Wenig et al., "WatchThru: Expanding Smartwatch Displays with Mid-air Visuals and Wrist-worn Augmented Reality", CHI, May 6-11, 2017, 6 pages.
Leithinger et al., "Sublimate: State-Changing Virtual and Physical Rendering to Augment Interaction with Shape Displays", CHI, Apr. 27-May 2, 2013, Paris, France, 10 pages.
Bell et al., "Dynamic Space Management for User Interfaces", UIST 2000, San Diego, CA, 10 pages.
Burstyn et al, "DisplaySkin: Exploring Pose-Aware Displays on a Flexible Electrophoretic Wristband", TEI 2015, Jan. 15-19, 2015, Stanford, CA, 8 pages.
Chen et al., "Duet: Exploring Joint Interactions on a Smart Phone and a Smart Watch", CHI 2014, One of a CHInd, Toronto, ON, Canada, 10 pages.
Lyons et al., "Facet: A Multi-Segment Wrist Worn System", UIST, Oct. 7-10, 2012, Cambridge, Massachusetts, USA. 7 pages.
Xu et al., "Shimmering Smartwatches: Exploring the Smartwatch Design Space", TEI 2015, Jan. 15-19, 2015, Stanford, CA, USA, 8 pages.
Olberding et al., "AugmentedForearm: Exploring the Design Space of a Display-enhanced Forearm", 4th Augmented Human International Conference (AH'13), Mar. 7-8, 2013, Stuttgart, Germany, 4 pages.
Pohl et al., "ScatterWatch: Subtle Notifications via Indirect Illumination Scattered in the Skin", MobileHCl '16, Sep. 6-9, 2016, Florence, Italy, 10 pages.
Lyons, "What Can a Dumb Watch Teach a Smartwatch? Informing the Design of Smartwatches", ISWC '15, Sep. 7-11, 2015, Osaka, Japan, 8 pages.
Jeong et al., "SmartwatchWearing Behavior Analysis: A Longitudinal Study", Proceedings of the ACM on Interactive, Mobile, Wearable and Ubiquitous Technologies, vol. 1, No. 3, Article 60. Publication date: Sep. 2017, 31 pages.
Song et al., "Hot & Tight: Exploring Thermo and Squeeze Cues Recognition on Wrist Wearables", ISWC '15, Sep. 7-11, 2015, Osaka, Japan, 4 pages.
Xiao et al., "Expanding the Input Expressivity of Smartwatches with Mechanical Pan, Twist, Tilt and Click", CHI 2014, Apr. 26-May 1, 2014, Toronto, ON, Canada, 4 pages.
Laput et al., "Skin Buttons: Cheap, Small, Low-Power and Clickable Fixed-Icon Laser Projections", UIST '14, Oct. 5-8, 2014, Honolulu, HI, USA, 6 pages.
Gong et al., "Cito: An Actuated Smartwatch for Extended Interactions", CHI 2017, May 6-11, 2017, Denver, CO, USA, 15 pages.
Seyed et al, "Doppio: A Reconfigurable Dual-Face Smartwatch for Tangible Interaction", CHI 2016, May 7-12, 2016, San Jose, CA, USA, 12 pages.
Weigel et al., "SkinMarks: Enabling Interactions on Body Landmarks Using Conformal Skin Electronics", CHI 2017, May 6-11, 2017, Denver, CO, USA, 11 pages.
International Search Report and Written Opinion for International Application No. PCT/US2019/025563 dated Jul. 17, 2019. 12 pages.

* cited by examiner

200

300

400

600

500

700

800

900

1020

1010

1000

1100

BIDIRECTIONAL AND EXPRESSIVE INTERACTION IN A HYBRID SMART WATCH

CROSS REFERENCE TO RELATED APPLICATIONS

The present application is related to U.S. Provisional Application No. 62/661,769, filed Apr. 24, 2018, the entire disclosure of which is incorporated by reference herein.

BACKGROUND

Personal information technology has rapidly evolved with the introduction of smartphones. Such devices are nearly ubiquitous. It is, however, increasingly challenging to conveniently access and carry smartphones due to expanding sizes and form factors. They can also be distracting to the user and those nearby. Wearable devices with smaller form factors have more recently been used to provide users with activity information, notifications and other functionality in a manner that is more user-friendly and less distracting.

There are different types of wearable devices. One type that is becoming more and more popular is the smartwatch. In addition to telling time, smartwatches may run various apps and or perform in a manner similar to a smartphone. Thus, smartwatches can address the smartphone size issue, and may provide relevant information to a user in a more discreet manner than a smartphone.

BRIEF SUMMARY

Hybrid smartwatches incorporate digital technology with an analog timepiece in a wristwatch form factor. It is possible to treat the graphical display of the digital technology and the mechanical hands of the analog display as separate display surfaces. However, aspects of the disclosure employ symbiotic and synchronized use of both display surfaces to provide new types of information to the user and to otherwise enhance existing applications. This is done in a way that leverages the strengths and efficiencies of the analog and digital components, while conserving power and extending battery life.

Aspects of the technology involve a hybrid smartwatch configured to provide mechanical expressivity to a user. The hybrid smartwatch comprises a user interface subsystem, a mechanical movement control subsystem and one or more processors. The user interface subsystem includes a digital graphical display and a mechanical movement having one or more watch hands. The one or more watch hands are arranged along a face of the hybrid smartwatch. The mechanical movement control subsystem is operatively coupled to the one or more watch hands, and is configured to adjust the one or more watch hands in one or both of clockwise and counterclockwise directions. The one or more processors are operatively coupled to the digital graphical display and the mechanical movement control subsystem. The one or more processors are configured to select an expressive visualization to be presented to a user using the one or more watch hands. The expressive visualization provides a predetermined adjustment of one or more of the watch hands. The one or more processors are also configured to determine whether to concurrently present visual information on the digital graphical display along with the adjustment of the one or more watch hands and to instruct the mechanical movement control subsystem to adjust the one or more watch hands according to the selected expressive visualization. Upon a determination to concurrently present the visual information on the digital graphical display, the one or more processors are configured to cause the digital graphical display to present the visual information contemporaneously with the adjustment of the one or more watch hands.

In one example, the one or more processors are configured to select the expressive visualization based on one or more identified items of information to be provided to the user. In another example, the mechanical movement control subsystem includes a plurality of actuators, each actuator configured to rotate a given one of the watch hands. The digital graphical display may comprise a non-emissive display.

In one scenario, the expressive visualization is a buzzing visualization. Here, the mechanical movement control subsystem is configured to adjust the one or more watch hands to provide the buzzing visualization by oscillating one or more of the watch hands at a selected oscillating rate between two and five repetitions.

In another scenario, the expressive visualization is an anthropomorphic behavior. Here, the mechanical movement control subsystem is configured to adjust the one or more watch hands to provide the anthropomorphic behavior by rotating a pair of the watch hands towards and away from one another by either a same amount a plurality of times or by a different amount a plurality of times.

In a further scenario, the expressive visualization is a facial visualization. Here, the mechanical movement control subsystem is configured to align a first one of the watch hands at approximately 9 o'clock on the watch face and align a second one of the watch hands at approximately 3 o'clock on the watch face, and to provide the facial visualization by simultaneously adjusting the first and second watch hands clockwise and counterclockwise by between 2-15°. The one or more processors are configured to cause the digital graphical display to present the visual information along with the adjusting of the first and second watch hands. The visual information includes one or more facial features.

In yet another scenario, the expressive visualization is an information hiding visualization and the visual information is a notification to the user. Here, the mechanical movement control subsystem is configured to adjust the one or more watch hands to provide the information hiding visualization by arranging a first one of the watch hands at a particular location along the watch face, and adjusting a second one of the watch hands to appear to tap down on the notification multiple times by moving towards and away from the first watch hand. In this case, with each tap the notification is reduced in size.

In another scenario, the expressive visualization is an information revealing visualization and the visual information is a notification to the user. Here, the mechanical movement control subsystem is configured to adjust the one or more watch hands to provide the information revealing visualization by arranging a first one of the watch hands at a particular location along the watch face, and adjusting a second one of the watch hands to appear to open up the notification multiple times. In this case, with each adjustment of the second watch hand the notification increases in size.

In a further scenario, the expressive visualization is a physics simulation and the visual information is a selected object. Here, the mechanical movement control subsystem is configured to adjust one or more of the watch hands to provide the physics simulation by adjusting the one or more watch hands in selected directions by between 1-180°. In this case, with each adjustment the selected object is either apparently moved by a given one of the watch hands, or a given one of the watch hands is apparently moved by the selected object.

In accordance with other aspects of the disclosure, a method of providing mechanical expressivity to a user with a hybrid smartwatch is provided. The hybrid smartwatch includes a digital graphical display and one or more physical watch hands arranged along a face of the hybrid smartwatch. The method includes selecting, by one or more processors, an expressive visualization to be presented to a user using the one or more watch hands. The expressive visualization provides a predetermined adjustment of one or more of the watch hands. The method also includes determining, by the one or more processors, whether to concurrently present visual information on the digital graphical display along with the adjustment of the one or more watch hands; instructing, by the one or more processors, a mechanical movement control subsystem of the hybrid smartwatch to adjust the one or more watch hands according to the selected expressive visualization; and upon a determination to concurrently present the visual information on the digital graphical display, the one or more processors causing the digital graphical display to present the visual information contemporaneously with the adjustment of the one or more watch hands.

In one example, the expressive visualization is selected based on one or more identified items of information to be provided to the user. In another example, the expressive visualization is a buzzing visualization. Here, the buzzing visualization is provided by oscillating one or more of the watch hands at a selected oscillating rate between two and five repetitions. In this case, the one or more watch hands may oscillate at a rate of between 1-6 Hz.

In a further example, the expressive visualization is an anthropomorphic behavior. Here, the one or more watch hands are adjusted to provide the anthropomorphic behavior by rotating a pair of the watch hands towards and away from one another by either a same amount a plurality of times or by a different amount a plurality of times. In this case, the different amount may include a first one of the watch hands appearing to clap against a stationary second one of the watch hands.

In yet another example, the expressive visualization is a facial visualization. Here, a first one of the watch hands is aligned at approximately 9 o'clock on the watch face and a second one of the watch hands is aligned at approximately 3 o'clock on the watch face, and providing the facial visualization is performed by simultaneously adjusting the first and second watch hands clockwise and counterclockwise by between 2-15°. The one or more processors cause the digital graphical display to present the visual information along with the adjusting of the first and second watch hands. The visual information includes one or more facial features.

In a further example, the expressive visualization is an information hiding visualization and the visual information is a notification to the user. Here, the one or more watch hands are adjusted to provide the information hiding visualization by arranging a first one of the watch hands at a particular location along the watch face, and adjusting a second one of the watch hands to appear to tap down on the notification multiple times by moving towards and away from the first watch hand. With each tap the notification is reduced in size.

In yet another example, the expressive visualization is an information revealing visualization and the visual information is a notification to the user. Here, the one or more watch hands are adjusted to provide the information revealing visualization by arranging a first one of the watch hands at a particular location along the watch face, and adjusting a second one of the watch hands to appear to open up the notification multiple times. With each adjustment of the second watch hand the notification increases in size.

And in yet another example the expressive visualization is a physics simulation and the visual information is a selected object. Here, the physics simulation is provided by adjusting the one or more watch hands in selected directions by between 1-180°. With each adjustment, the selected object either is apparently moved by a given one of the watch hands, or a given one of the watch hands is apparently moved by the selected object.

DETAILED DESCRIPTION

Overview

The analog and digital display elements in a hybrid smartwatch as discussed herein provide a rich graphical interface in a wearable form factor. Programmable materials are utilized in conjunction with electromechanical control of the watch hands. The programmable materials may include electronic ink (E-ink) pigments or other non-emissive arrangements that are capable of displaying dynamic patterns. A mechanical movement control manages positioning of the watch hands. For instance, micro-stepper motors provide control, positioning and mechanical expressivity via resulting hand movement. While these servo-controlled hands are overlaid on a graphical display, the system coordinates the analog and digital displays to share responsibilities for the user interface.

Example System

Figure 1:
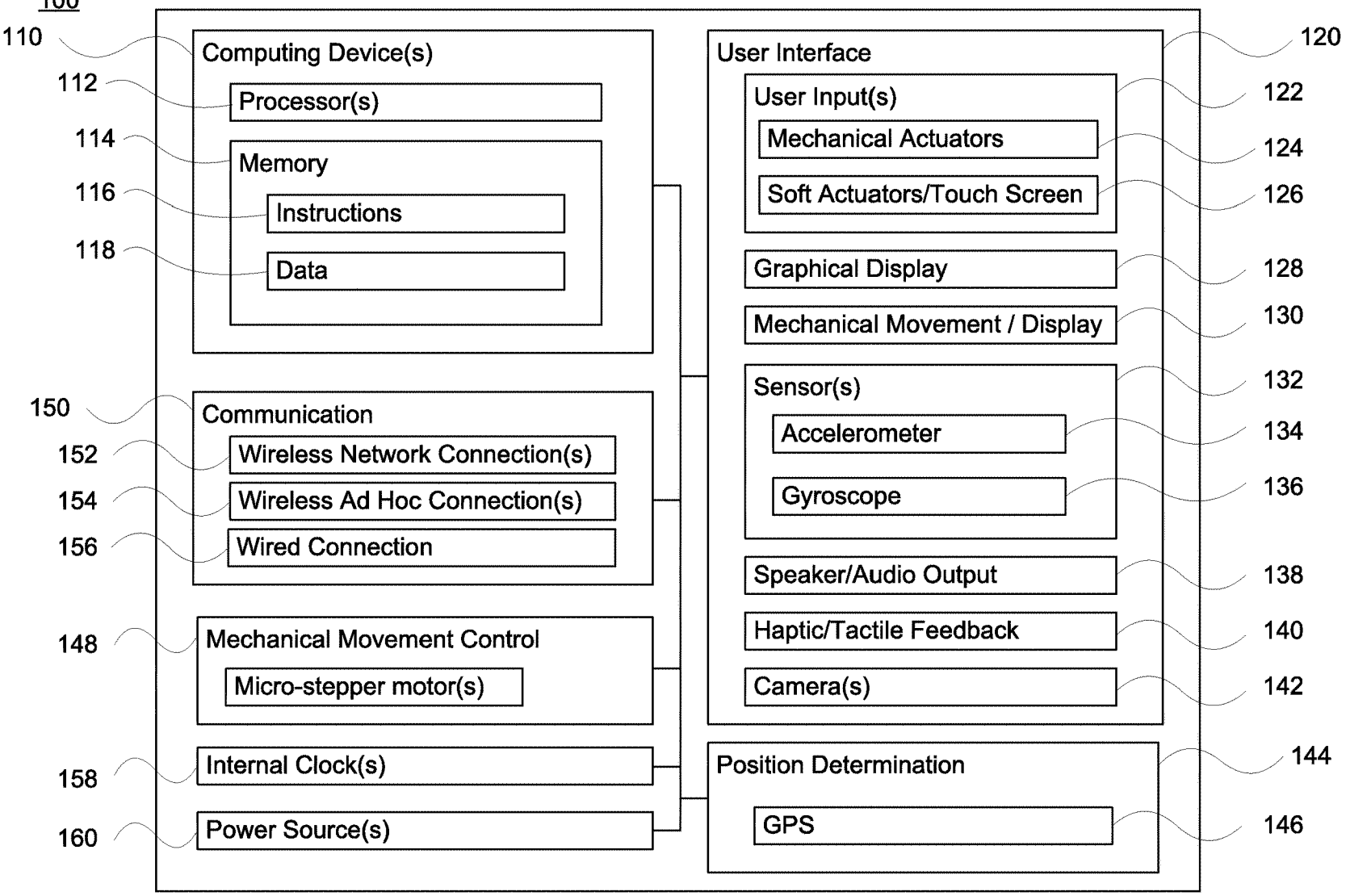
FIG. 1 is a functional diagram of an example hybrid smartwatch in accordance with aspects of the disclosure.

As shown in FIG. 1, a hybrid smartwatch 100 in accordance with one aspect of the disclosure includes various components. The hybrid smartwatch may have one or more computing devices, such as computing device 110 containing one or more processors 112, memory 114 and other components typically present in a smartphone or other personal computing device. The one or more processors 112 may be processors such as commercially available CPUs. Alternatively, the one or more processors may be a dedicated device such as an ASIC, a single or multi-core controller, or other hardware-based processor.

The memory 114 stores information accessible by the one or more processors 112, including instructions 116 and data 118 that may be executed or otherwise used by each processor 112. The memory 114 may be, e.g., a solid state memory or other type of non-transitory memory capable of storing information accessible by the processor(s), including write-capable and/or read-only memories.

The instructions 116 may be any set of instructions to be executed directly (such as machine code) or indirectly (such as scripts) by the processor. For example, the instructions may be stored as computing device code on the computing device-readable medium. In that regard, the terms "instructions" and "programs" may be used interchangeably herein. The instructions may be stored in object code format for direct processing by the processor, or in any other computing device language including scripts or collections of independent source code modules that are interpreted on demand or compiled in advance. Functions, methods and routines of the instructions are explained in detail below.

The data 118 may be retrieved, stored or modified by processor 112 in accordance with the instructions 116. As an example, data 118 of memory 114 may store predefined scenarios. A given scenario may identify a set of scenario requirements including visual effect types, content to be presented and pre-defined interactions between the watch hands and the graphical display. For instance, particular movements of the watch hands in combination with selected notification types may be included in the predefined scenarios.

User interface 120 includes various I/O elements. For instance, one or more user inputs 122 such as mechanical actuators 124 and/or soft actuators 126 are provided. The mechanical actuators 124 may include a crown, buttons, switches and other components. The soft actuators 126 may be incorporated into a touchscreen cover, e.g., a resistive or capacitive touch screen.

As noted above, one aspect of the technology is the use of analog watch elements enhanced with digital capabilities and connectivity. Thus, both a digital graphical display 128 and a mechanical movement (analog display) 130 are provided in the user interface 120 of the hybrid watch 100. The graphical display 128 may be an E-ink or other type of electrophoretic display. Alternatively, other non-emissive arrangements or even emissive displays may be employed. The mechanical movement 130 includes hour and minute hands. A seconds hand and/or other hand indicators may also be employed.

Figure 2:
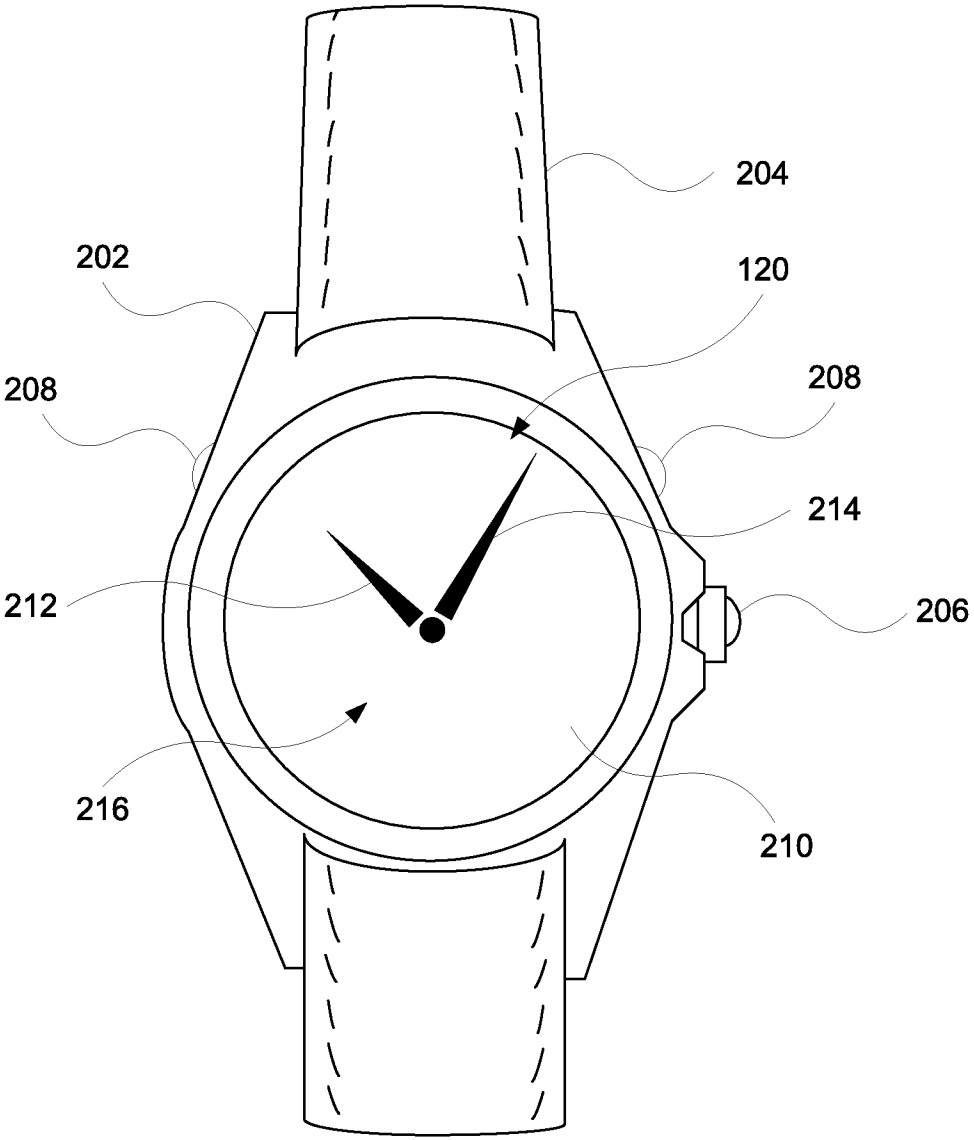
FIG. 2 illustrates an example hybrid smartwatch in accordance with aspects of the disclosure.

An example watch configuration 200 with such a user interface 120 is shown in FIG. 2. The example watch configuration 200 includes a watch housing 202 and a band 204 connected thereto. The mechanical actuators here include crown 206 and a pair of supplemental buttons 208. The number of mechanical actuators may vary, and may be more or less than the number shown. Actuators may be located on the band 204 in addition to or in place of actuators on the housing 202. In fact, in some instances there may be no mechanical actuators on the housing 202 or the band 204. One or more soft actuators may be incorporated into cover 210. Under the cover 210 are an hour hand 212 and a minute hand 214. Depending on the analog watch functionality, one or more additional hand indicators, e.g., a seconds hand or an alarm hand, may also be used. Or, alternatively, the watch style may dictate a watch having only one hand. In this example, the user interface 120 includes a circular graphical display 216. However, the graphical display 216 may have a different shape or size depending on the configuration of the watch housing 202. For instance, the graphical display 216 may be square, rectangular, octagonal or a different geometric shape.

Returning to FIG. 1, the user interface 120 may include additional components as well. By way of example, one or more sensors 132 may be located on or within the watch housing. The sensors may include an accelerometer 134, e.g., a 3-axis accelerometer, and/or a gyroscope 136. Other sensors may include a magnetometer, a barometric pressure sensor, an ambient temperature sensor, a skin temperature sensor, a heart rate monitor, an oximetry sensor to measure blood oxygen levels, and a galvanic skin response sensor to determine exertion levels. Additional or different sensors may also be employed.

The user interface 120 may also include one or more speakers, transducers or other audio outputs 138. A haptic interface or other tactile feedback 140 is used to provide non-visual and non-audible information to the wearer. And one or more cameras 142 can be included on the housing, band or incorporated into the display.

The hybrid smartwatch 100 also includes a position determination module 144, which may include a GPS chipset 146 or other positioning system components. Information from the accelerometer 134, gyroscope 136 and/or from data received or determined from remote devices (e.g., wireless base stations or wireless access points), can be employed by the position determination module 144 to calculate or otherwise estimate the physical location of the smartwatch 100.

In order to obtain information from and send information to remote devices, the smartwatch 100 may include a communication subsystem 150 having a wireless network connection module 152, a wireless ad hoc connection module 154, and/or a wired connection module 156. While not shown, the communication subsystem 150 has a baseband section for processing data and a transceiver section for transmitting data to and receiving data from the remote devices. The transceiver may operate at RF frequencies via one or more antennae. The wireless network connection module 152 may be configured to support communication via cellular, LTE, 4G and other networked architectures. The wireless ad hoc connection module 154 may be configured to support Bluetooth, Bluetooth LE, near field communications, and other non-networked wireless arrangements. And the wired connection 156 may include a USB, micro USB, USB type C or other connector, for example to receive data and/or power from a laptop, tablet, smartphone or other device.

Figure 3:
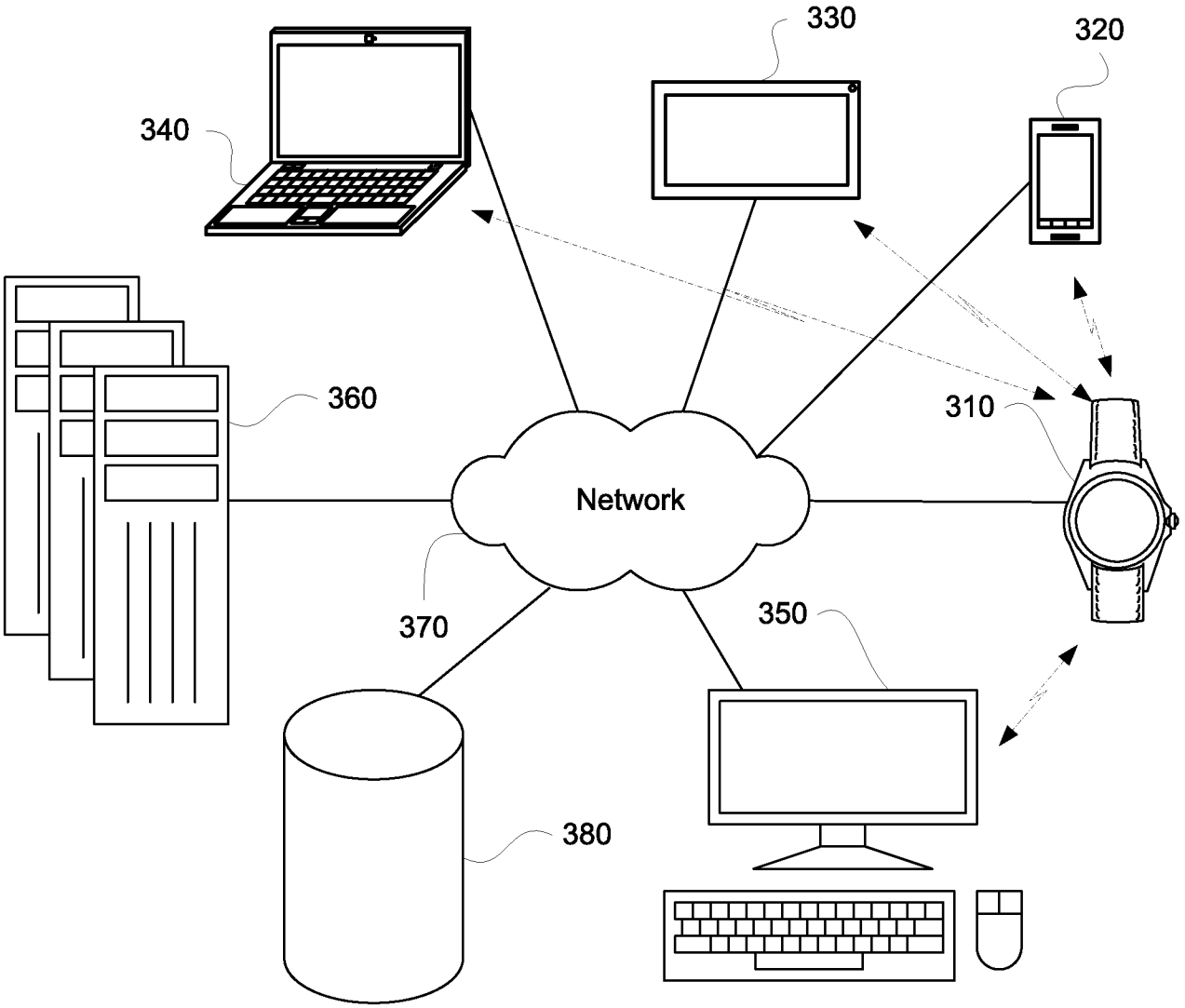
FIG. 3 is an example pictorial diagram of a networked or ad hoc system in accordance with aspects of the disclosure.

FIG. 3 is a pictorial diagram of an example system 300 that includes one or more hybrid smartwatches 310 or other wearable personal devices, as well as remote user devices such as smartphone 320, tablet computer 330, laptop computer 340, desktop PC 350 and a remote server system 360 connected via a network 370. System 300 may also include one or more databases 380, which may be operatively associated with the server system 360. Although only a few devices are depicted for simplicity, the system 300 may include significantly more. Each client device and the server system may include one or more processors, memory, data and instructions. Such processors, memories, data and instructions may be configured similarly to one or more processors, memory, data, and instructions of computing device 110. The hybrid smartwatch(es) 310 may also communicate directly with smartphone 320, tablet computer 330, laptop computer 340 and/or desktop PC 350, for instance via an ad-hoc arrangement or wired link, as shown by the dash-dot arrows. The hybrid smartwatch(es) may obtain data, instructions, apps or other information from any of the remote devices, and may use such information when communicating with the user via the user interface of the watch. For instance, an app on smartphone 320, tablet 330 or laptop 340 may provide information to or control what is presented to the user on the hybrid smartwatch 310. This can include email, calendar or other content.

Returning to FIG. 1, the hybrid smartwatch 100 includes a mechanical movement control 148 to manage the positioning and movement of the watch hands of the analog display. One or more internal clocks 158 providing timing information, which can be used for timekeeping with the watch hands, time measurement for apps and other programs run by the smartwatch, and basic operations by the computing device(s) 110, GPS 146 and communication subsystem 150. And one or more power source(s) 160 provide power to the various components of the smartwatch. The power source(s) may include a battery, winding mechanism, solar cell or combination thereof. The computing devices may be operatively couples to the other subsystems and components via a wired bus or other link, including wireless links.

Figure 4:
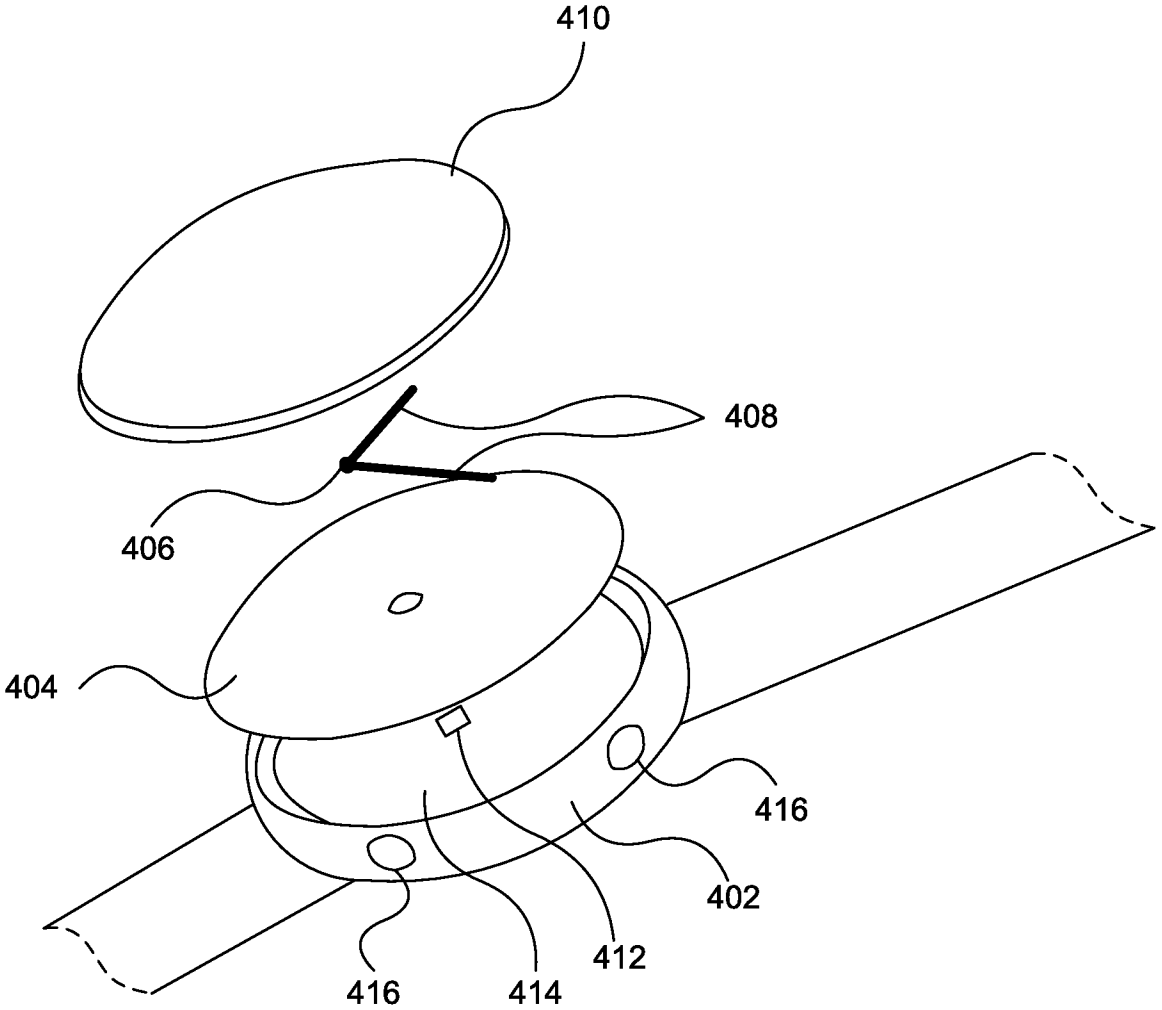
FIG. 4 illustrates a component view of a hybrid smartwatch in accordance with aspects of the disclosure.

FIG. 4 is an exploded view of an example smartwatch 400 in accordance with aspects of the disclosure. As shown, the housing 402 is arranged to receive a graphical display 404, a mechanical movement component 406, one or more watch hands 408 coupled to the mechanical movement component 406, and a cover 410, such as a transparent glass or plastic cover. The mechanical movement control may include one or more micro-stepper motors or another actuation mechanism 412 disposed on a printed circuit board (PCB) 414. A spacer element (not shown) may be arranged between the PCB 414 and the graphical display 404. One or more mechanical actuators, e.g., tactile buttons 416, are disposed on the housing 402 and operatively coupled to the PCB 414.

As noted above, the micro-stepper motors or other actuation mechanism(s) 412 are configured to provide control, positioning and mechanical expressivity via resulting hand movement, for instance by causing the one or more hands to rotate or otherwise adjust in a predetermined manner. The micro-stepper motors enable unidirectional or bidirectional rotation of the hands (clockwise and/or counterclockwise) through electrical pulses that may be controlled by the one or more processors 112 of FIG. 1. While the micro-stepper motors or other actuators 412 are shown as being mounted to the PCB, they may be affixed to a different substrate or component, or may be otherwise secured to the housing 402.

According to one scenario, the electrical pulses have a pulse width on the order of 2 ms, for instance between about 1.75-2.25 ms. Here, the minute and hour hands may have one the order of 120 steps per revolution, although the number of steps for each hand may vary. In other examples, the pulse widths and steps per revolution may vary, e.g., by +/−10%, or more or less. In some scenarios, the steps are related to the application. For instance, time-related apps may have a 60 step resolution, while other apps may employ a higher (or lower) number of steps. And the pulse width may vary based on motor characteristics of the actuator(s). The timing and duration of the pulses and steps is controlled, for example, by the one or more processors 112 of FIG. 1. The ability to mechanically configure the position of the hands enables the system to adapt the user interface along several dimensions. Should the micro-stepper motors fall out of sync with one another, this can be detected by encoders and/or sensors in the housing and corrected by the processing system.

The graphical display 404 includes, in this scenario, a non-emissive display. The non-emissive display is bi-stable, which does not require power to maintain the displayed information. The non-emissive display may be arranged as a circle or other shape depending on the overall appearance of the smartwatch. Nonetheless, the display includes a central opening adapted to receive the mechanical movement component 406 of FIG. 4. Depending on the size and shape of the display, different resolutions and colors or greyscales may be employed. For instance, the resolution may be 180×180, 240×240, 960×540, 1448×1072, 1200×1600, or higher or lower. The bit depth may be, e.g., 1-bit, 2-bit, 4-bit or more. If greyscale is used instead of a color palate, the greyscale may be, e.g., black and white, 4 greyscales, 16 greyscales or more or less. Alternatively, multi-color or full color displays of, e.g., 6-bit 8-bit or 16-bit or more may be employed. Such color displays may include active matrix LED (AMOLED), passive matrix LED (PMOLED), LCDs such as TFT LCDs, and transflective displays.

Example Scenarios

The control and interplay of the pixels of the display and the positioning of the hands is performed cooperatively to create optimal user interfaces for different scenarios. For example, the user interfaces may be optimized according to predetermined criteria, which can vary with different interactions, applications and user preferences.

Aspects of the technology employ physical motion of the watch hands as a means for expressivity. Here, the hands may be used for visual mechatronic effects as a complement or alternative to the information presented on the digital display. For instance, the hybrid smartwatch is able to attract the user's attention with motion of the hands when illumination or sound is inappropriate or insufficient. Various scenarios include buzzing, clapping, stylizing visual features, hiding or minimizing information, revealing information, and influence of display objects on physical hand and vice versa. These scenarios are described with reference to the drawings.

Figure 5:
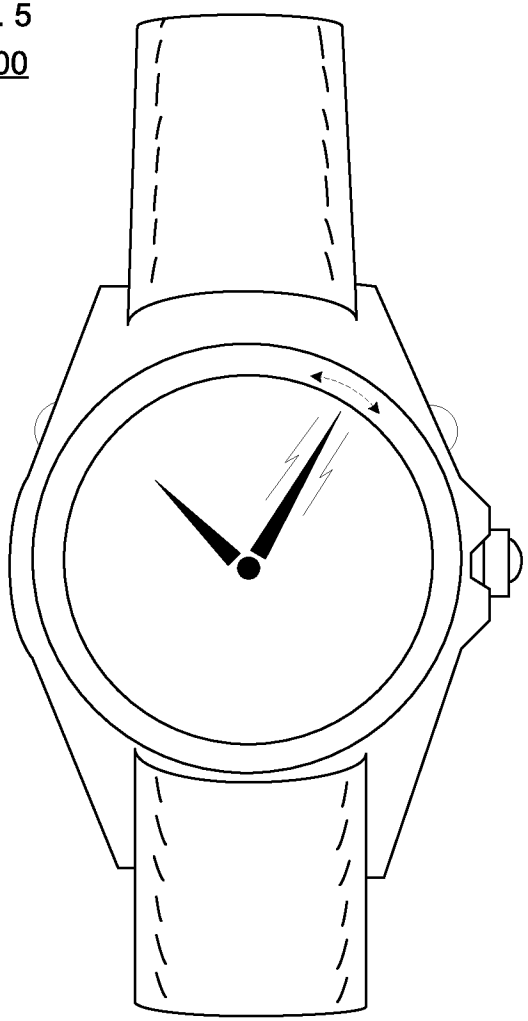
FIG. 5 illustrates an example of buzzing in accordance with aspects of the disclosure.

FIG. 5 illustrates one example 500 of buzzing. Here, one or more of the hands buzzes or shakes to visually indicate an alarm, timer, upcoming reminder, etc. This includes high frequency oscillating movement of the hand, as indicated by the jagged lines and dashed arrow adjacent to the minute hand. By way of example, the hand may oscillate at 1 Hz, 2 Hz, 6 Hz, or more or less. Here, the rapid oscillation may occur, e.g., three times. Alternatively, fewer or more than three repetitions may be employed. The rate can change during the buzzing, for instance starting slow (or fast) and then getting faster (or slower). The oscillating movement may be accompanied by digital augmentation on the digital display. For example, the digital display may present an alarm clock or the terms "BUZZ!" or "WAKE UP!". Alternatively, the digital augmentation can include motion blurred shadows of the hands or other shading, highlighting or emphasis of the hands. The driving of the hand(s) in this manner can also be used to mechanically create a noise and/or tactile vibration that can be sensed by the user, in addition to the visual movement.

Figure 6:
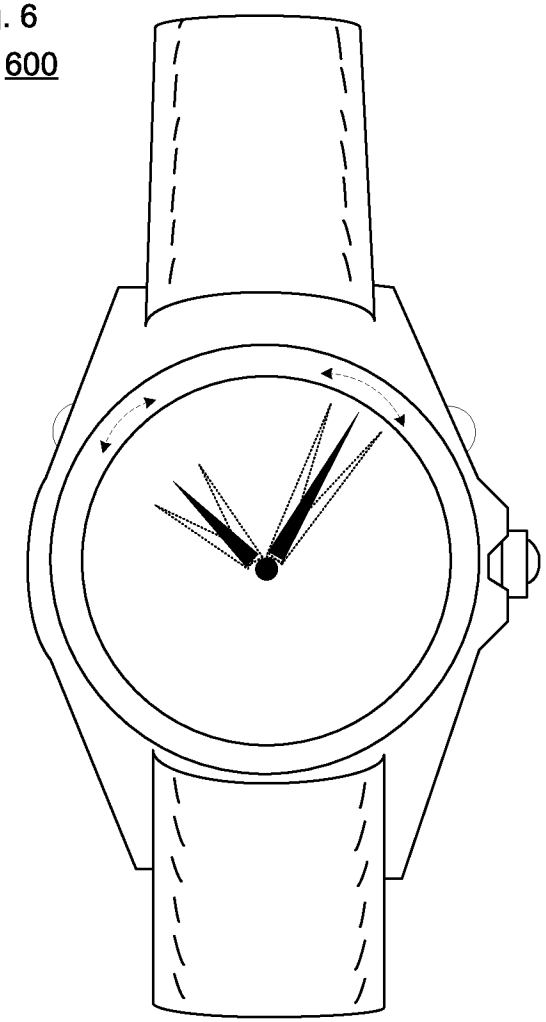
FIG. 6 illustrates an example of anthropomorphic behavior in accordance with aspects of the disclosure.

FIG. 6 illustrates an example 600 of anthropomorphic behavior using the minute and hour hands. The dashed arrows and the dotted lines indicate that the hands are moved closer and farther away from one another. This can be used to simulate gestures, such as hand clapping. In one scenario, this approach is used to indicate a completed goal, such as finishing a task (e.g., sending a text or email) or reaching an exercise threshold (e.g., jogging for 10 minutes). Here, the two hands may rotate away and towards each other multiple times (e.g., 2-10 times) by the same amount, such as +/−5-10°, or more or less. Alternatively, the two hands may move towards and away from each other by different amounts. In this case, one of the watch hands may not move at all, e.g., to simulate one hand clapping against the other hand.

Figure 7:
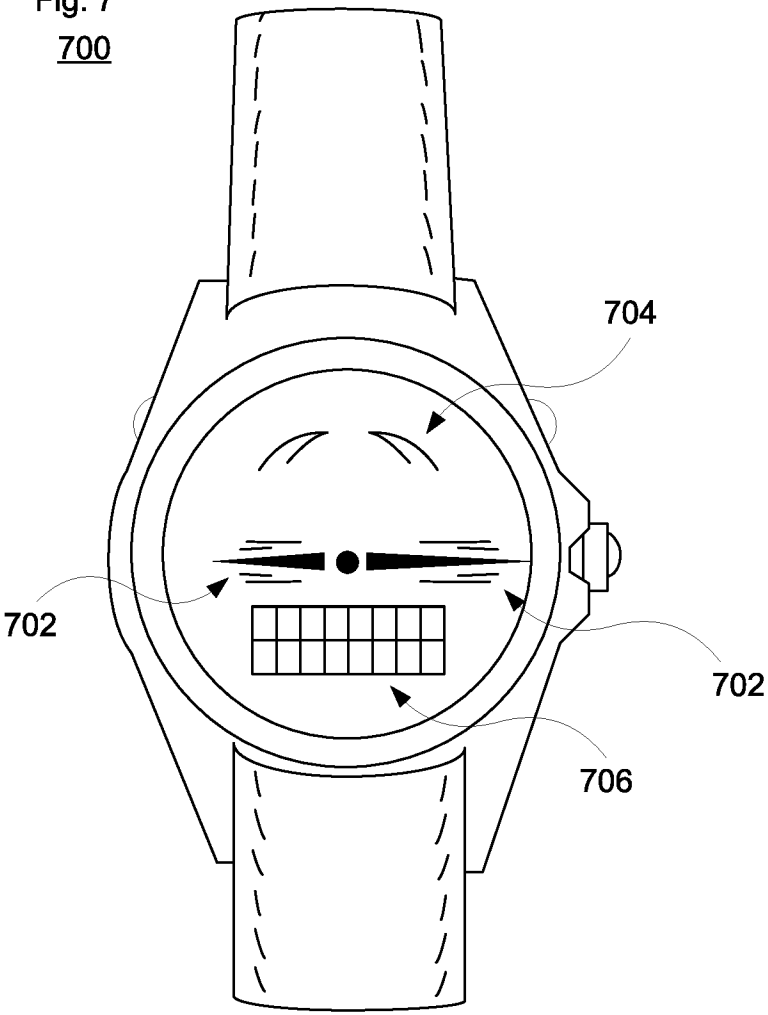
FIG. 7 illustrates exemplary visual features in accordance with aspects of the disclosure.

FIG. 7 illustrates an example 700 of expressive visual features. Here, a stylized face may be created by placing the hour hand at around 9 o'clock and the minute hand at around 15 minutes past the hour, and slightly moving them as shown by lines 702. Here, the slight movement may involve the hands rotating clockwise and counterclockwise by 2-15°, or more or less. In one example, the movement may be at 10-20 Hz, or more or less. This could indicate a mustache or whiskers, with the movement indicating, e.g., a grin or a smile. In conjunction with the hand movements, the digital display illustrates facial features 704 and 706, such as eyes and a mouth. Adjustment or variation of the facial features 704 and/or 706 may correlate to the adjustment of one or both of the hands. For instance, the appearance of the eyes and/or mouth may change as the hands move clockwise and counterclockwise.

Figure 8C:
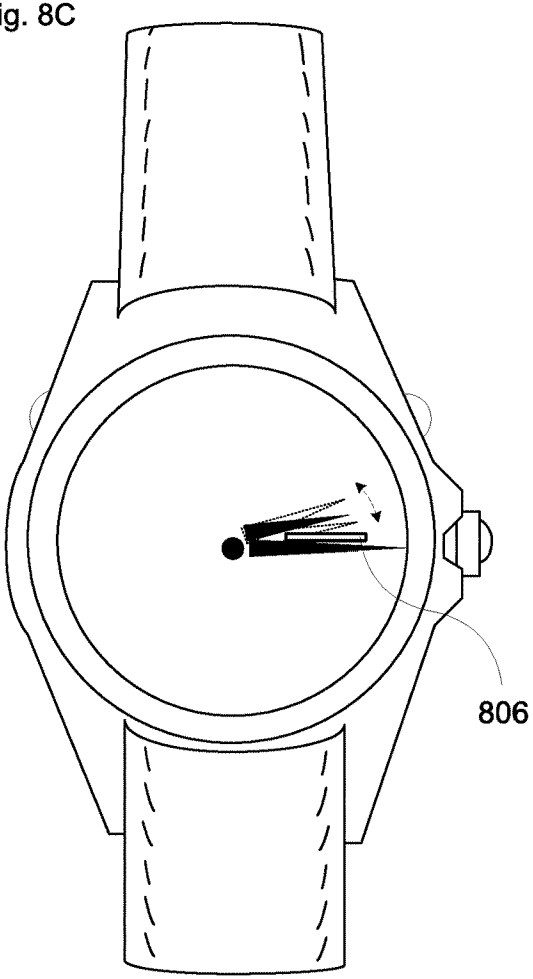
FIG. 8A-8C illustrate an example of tapping to hide information in accordance with aspects of the disclosure.
Figure 8B:
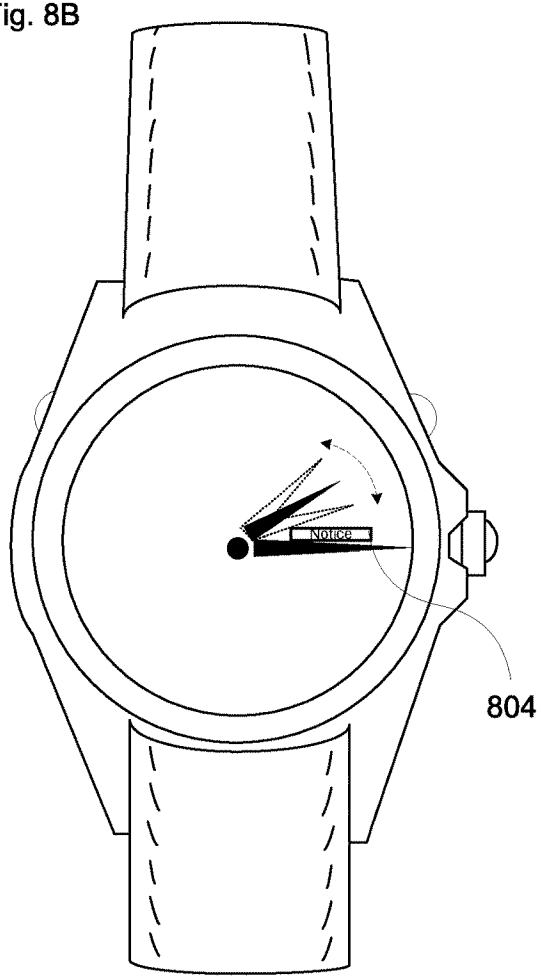
Figure 8A:
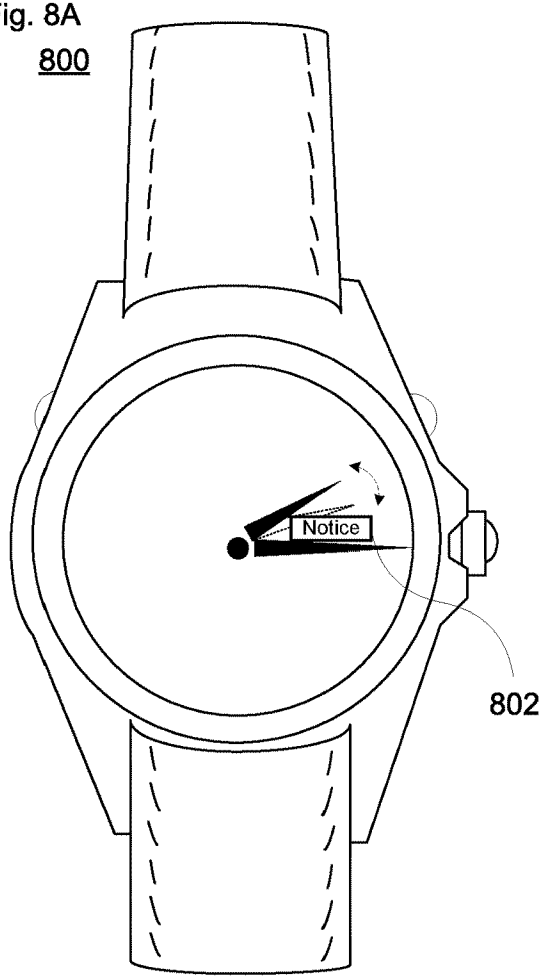

FIGS. 8A-8C illustrate an example 800 of tapping to hide information, such as a notification. Here, the minute hand is shown at around 15 minutes and the hour hand is adjusted to "tap" down on a notice, message or other notification (802, 804 and 806 in FIGS. 8A-8C, respectively), e.g., to "knock down" content on the screen. The content may be an icon, text, graphic, etc. The hour hand moves closer to the minute hand (e.g., clockwise) to apparently impact or squash the content, and then may move in the opposite (e.g., counterclockwise) direction before moving closer to the minute hand again. Each time the hour hand moves closer, the content gets smaller. With each subsequent iteration, the hour hand may rotate away from the minute hand to a lesser amount than the prior iteration, so that the relative spacing between the ends of the hour and minute hands gets closer together with each tap. As shown in the figures, the content of the graphical display is knocked down to reduce in size, and may eventually disappear. The specific placement of the hands and the notification may vary, depending on the content and/or size of the information being displayed. The number of "knocks" necessary to reduce the notification in size or eliminate it entirely may range, e.g., from 1 to 10 knocks, although more knocks may be employed. Each knock may take from 0.25 to 2.0 seconds, or more or less, and may also depend on the size and/or content of the notification. Alternatively, the arrangement of the hour and minute hands may be reversed, so that the minute hand moves to reduce or eliminate the notification.

Figure 9C:
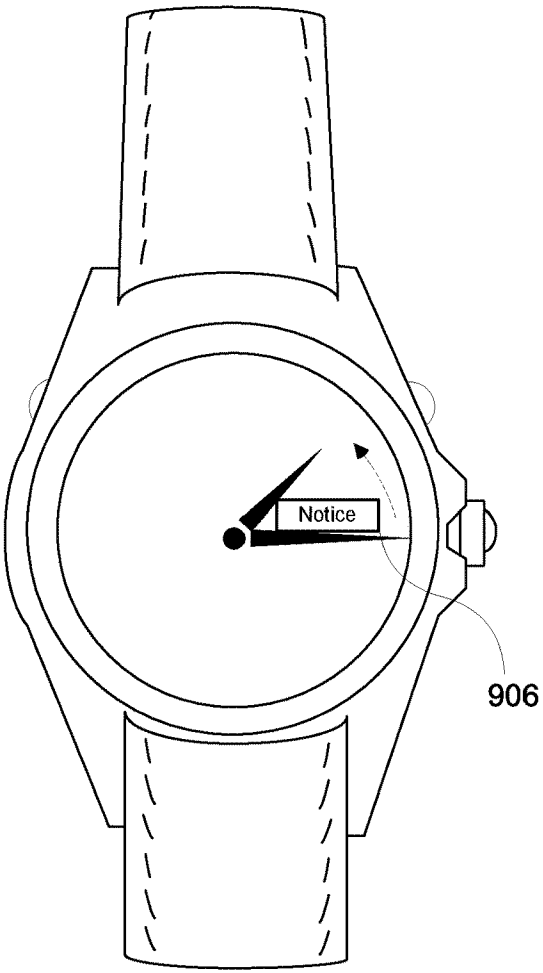
FIGS. 9A-9C illustrate an example of information reveal in accordance with aspects of the disclosure
Figure 9B:
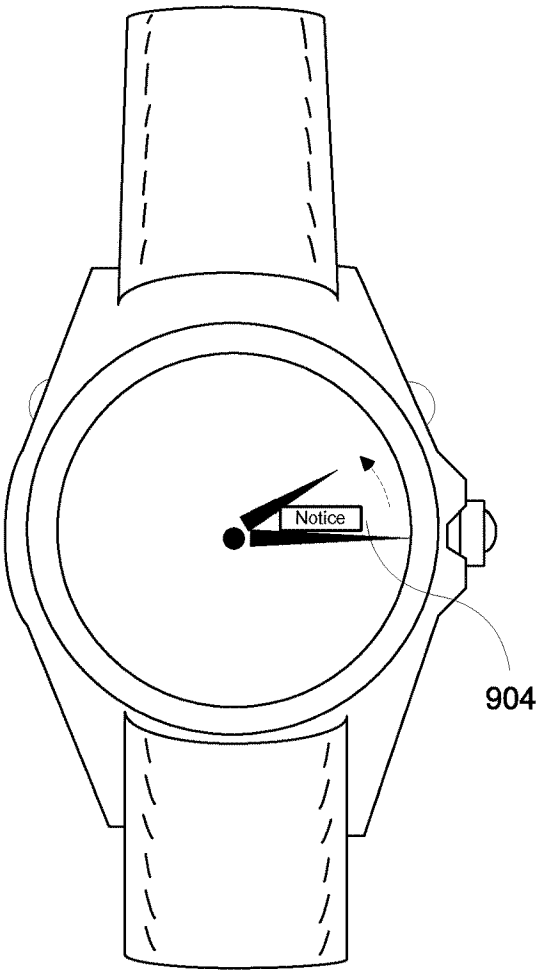
Figure 9A:
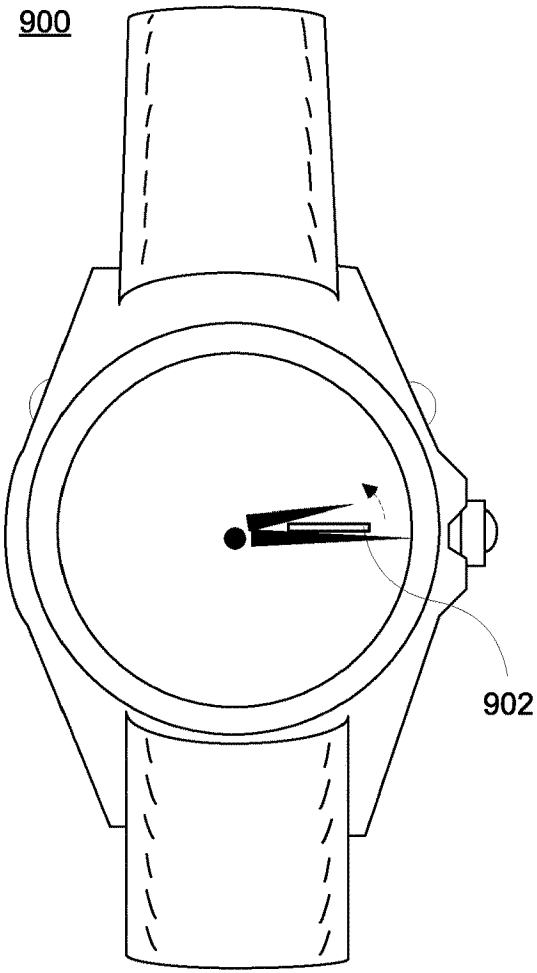

Conversely, FIGS. 9A-9C illustrate an example 900 of revealing information, such as a notification. Here, the minute hand is shown at around 15 minutes and the hour hand is adjusted to "open up" to gradually reveal (e.g., grow) a notice, message or other notification (902, 904 and 906 in FIGS. 9A-9C, respectively). As shown in the figures, the content of the graphical display is increased in size in the reveal. The specific placement of the hands and the notification may vary, depending on the content and/or size of the information being displayed. The number of adjustments of the hour (or other) hand necessary to increase the notification in size may range, e.g., from 1 to 10 adjustments, although more adjustments may be employed. Each adjustment may take from 0.25 to 2.0 seconds, or more or less, and may also depend on the size and/or content of the notification. With each subsequent iteration, the hour hand may rotate away from the minute hand to a greater amount than the prior iteration, so that the relative spacing between the ends of the hour and minute hands gets farther away with each adjustment. Alternatively, the arrangement of the hour and minute hands may be reversed, so that the minute hand moves to away from the hour hand to expand or grow the notification.

Figure 10C:
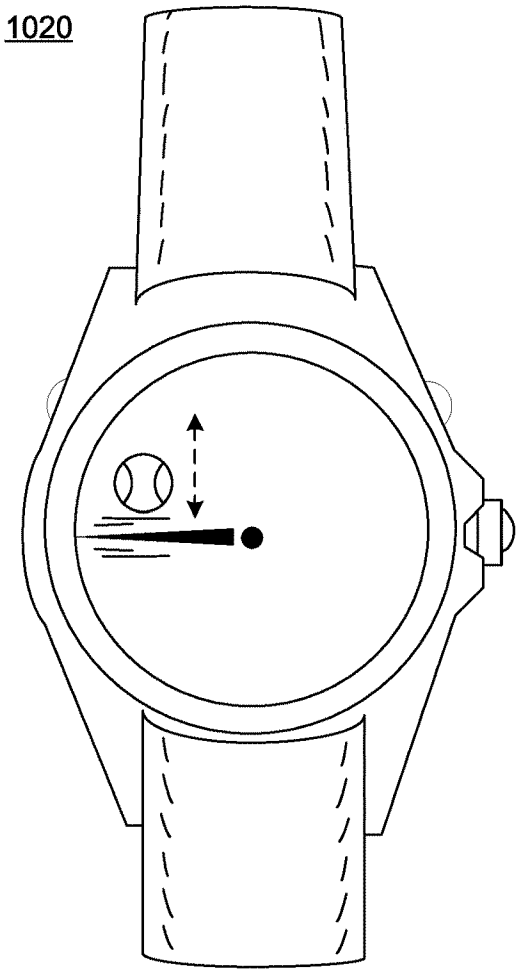
FIGS. 10A-F illustrate examples of physics-type behavior in accordance with aspects of the disclosure.
Figure 10B:
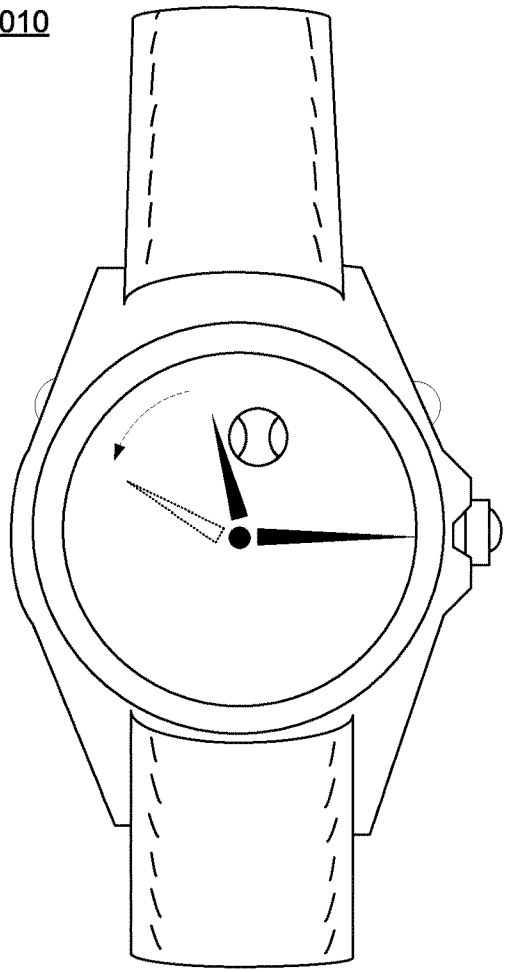
Figure 10A:
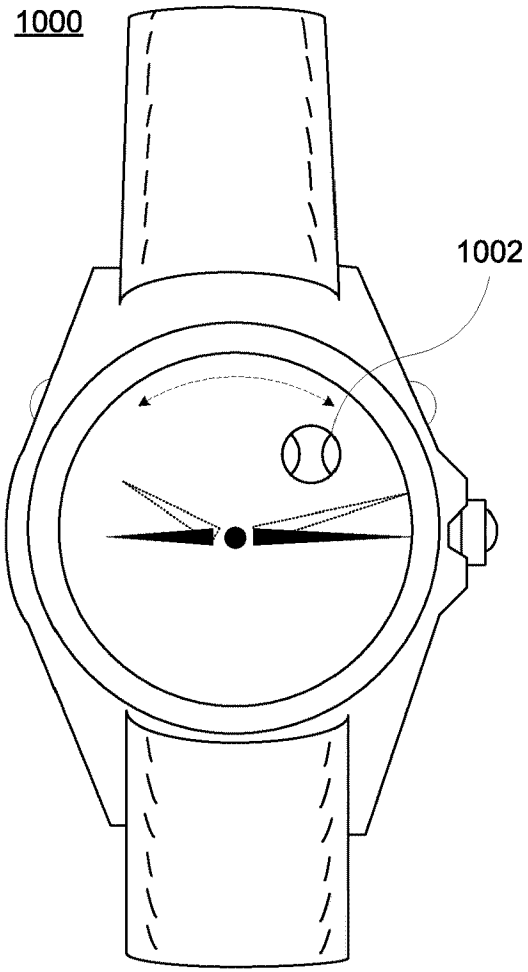

FIGS. 10A-F illustrates further examples, which present physics-type simulations that can show apparent collision or influence of the physical watch hands with the displayed graphics. For instance, FIGS. 10A-C present images of a game showing the interplay between the physical hands and the display screen. Here, FIG. 10A presents a view 1000 of a ball 1002 or other object on the display screen, which may be bounced, dribbled, hit or otherwise apparently moved by adjustment of the watch hands. As shown by the dotted lines, the hour and minute hands may move upward like a flipper of a pinball game, e.g., by rotating clockwise and/or counterclockwise by between 1-45°. In conjunction with the movement of the hands, the ball 1002 moves in an arcuate or other fashion, as shown by the dashed double arrow, giving the appearance that the ball is being moved by the hands. Other scenarios are possible, such as dribbling a basketball, throwing a football, kicking a soccer ball, etc.

FIG. 10B illustrates an alternative game-type scenario 1010 in which the displayed image of the ball or other object appears to collide or otherwise contact one of the watch hands. Here, this apparent collision or impact causes the hand to move, e.g., in a counterclockwise direction as indicated by the dashed arrow. FIG. 10C illustrates another scenario 1020. In this scenario, the ball or other object appears to bounce up and down as shown by the vertical double dashed arrow. Here, the watch hand vibrates up and down, e.g., by +/−5-10 degrees, in apparent response to the bouncing ball.

Figure 10F:
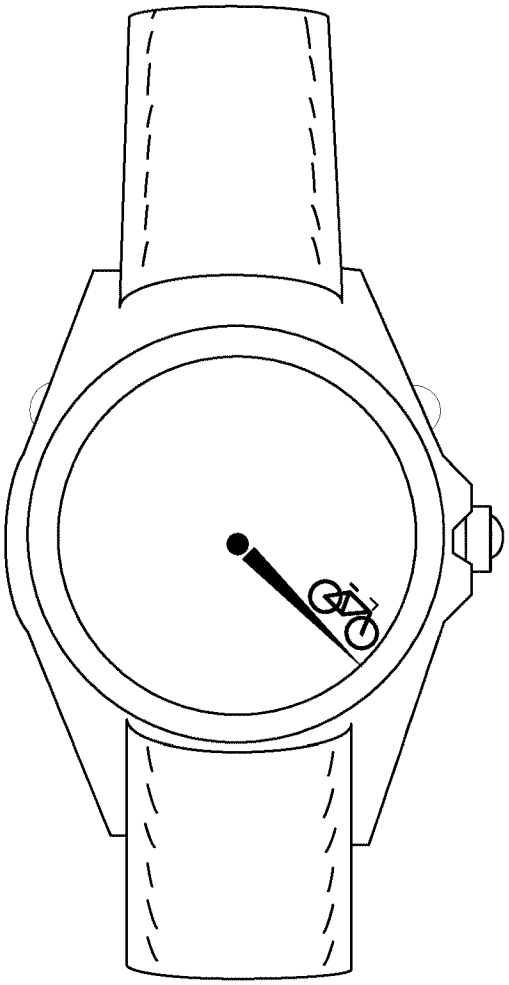
Figure 10E:
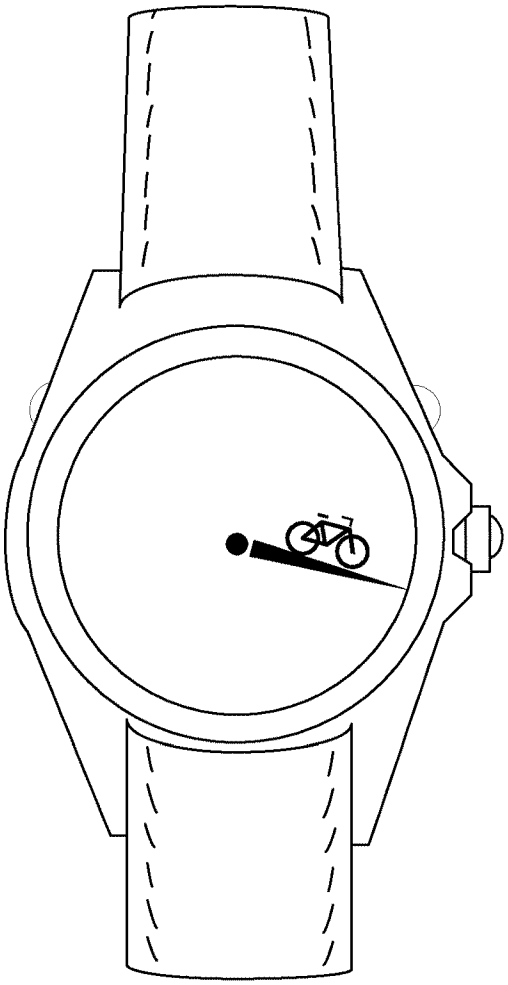
Figure 10D:
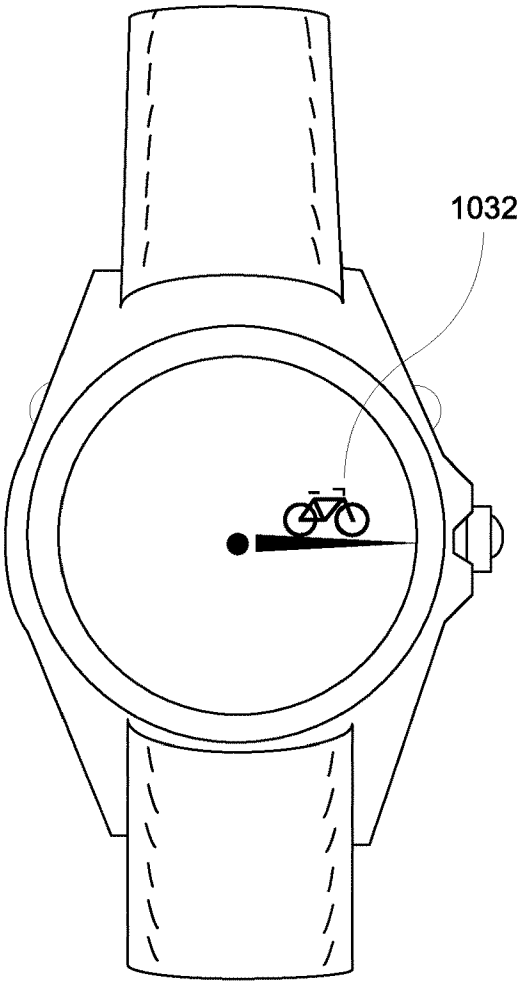

In contrast, FIGS. 10D-10F illustrate a scenario in which movement of a watch hand causes an apparent reaction by the displayed object, such as a gravitational movement of the object. As seen at point 1030 of FIG. 10D, a bicycle, motorcycle or other object 1032 presented on the graphical display appears to rest on the watch hand, which is pointing toward 3 o'clock or 15 minutes past the hour on the watch face. As seen at point 1040 of FIG. 10E, as the watch hand begins to turn downward, e.g., toward about 4 o'clock or 20 minutes past the hour, the object 1032 starts moving towards the edge of the watch face. This gives the appearance that the bicycle or other object 1032 is going downhill. This process continues at point 1050 of FIG. 10F. Here, the watch hand now points toward 5 o'clock or about 25 minutes past the hour. As shown, the bicycle or other object 1032 has now moved to the edge of the watch face. The rate of movement of the bicycle may mimic what a real bicycle would experience due to the gravitational pull in accordance with the slope of the watch hand.

The examples of FIGS. 5-10 use physical motion of the watch hand(s) as a means for expressivity, either alone or in coordinated operation with the graphical display. This enhances the functionality of the hybrid smartwatch, providing the user (e.g., the wearer) with an enriching user experience. It also provides information in an efficient manner, which can be specifically tailored to the user and/or the content while being unobtrusive to others nearby.

Figure 11:
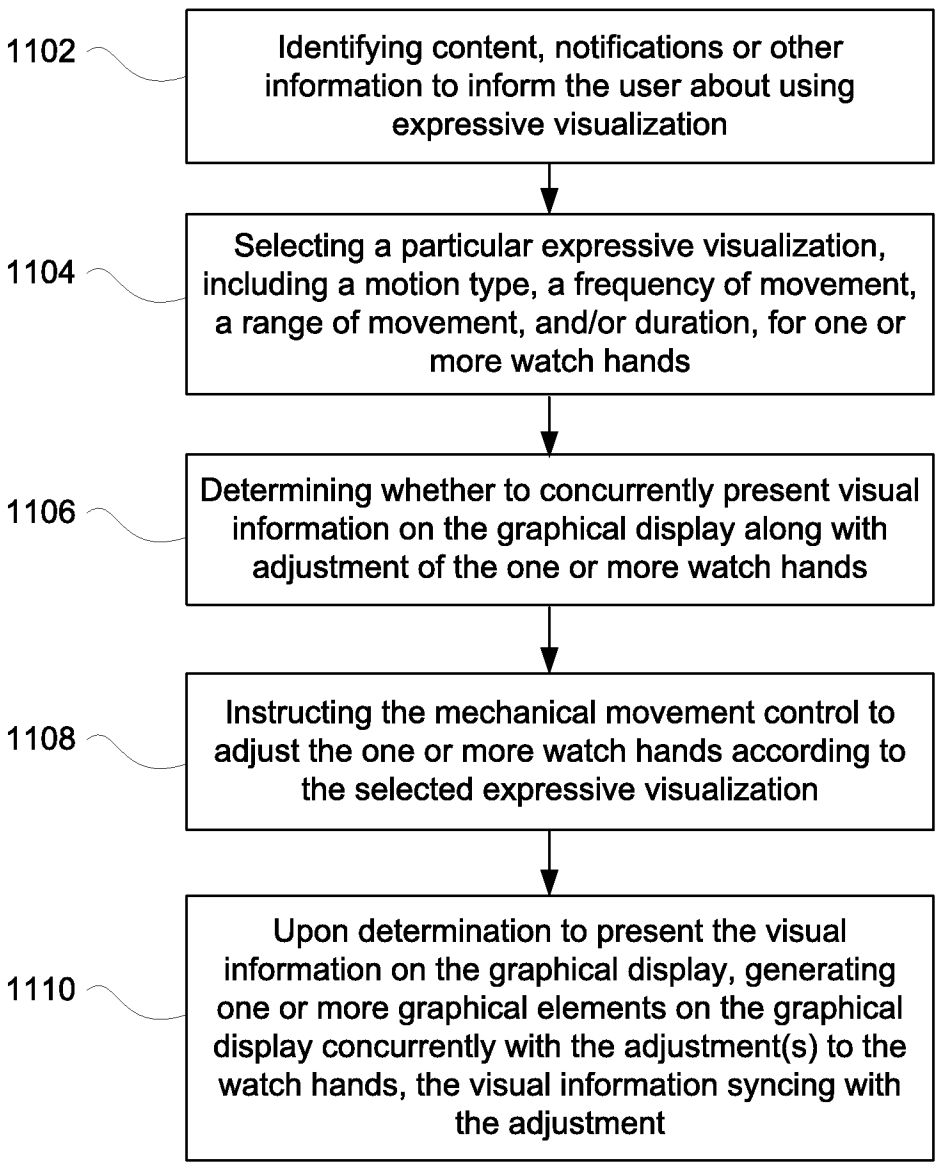
FIG. 11 is a flow diagram in accordance with aspects of the disclosure.

FIG. 11 is a flow diagram 1100 that may be performed by one or more processors such as one or more processors 120 of computing device 110. As shown in block 1102, the one or more processors identify information (e.g., content or notifications) that is to be provided to the user, for instance to inform the user about a condition, event or activity. Per block 1104, the processor(s) selects a particular expressive visualization, such as any of the visualizations shown in FIGS. 5-10. The selection may include identifying a motion type, a frequency of movement, a range of movement, and/or duration of movement. The expressive visualization may involve only one hand, or two (or more) hands. This may also include determining whether a haptic or tactile effect is to be produced by the hand(s).

At block 1106, the processors determine whether to concurrently present visual information on the graphical display along with the adjustment of the one or more watch hands. Not every expressive visualization necessarily includes the presentation of corresponding visual information on the graphical display. At block 1108, the processors instruct or otherwise manage the mechanical movement control to adjust the hand(s), in accordance with the selected expressive visualization. This may include sending control signals to the mechanical movement subsystem or electrical pulses directly to micro-stepper motors to achieve the intended hand motion.

At block 1110, when it is determined that visual information will also be presented on the graphical display, the one or more processors cause the graphical display to generate the graphical element(s) thereon. This is done in conjunction with the expressive visualization of the hand adjustment. According to one aspect, the visual information of the graphical element(s) is synced with the mechanical adjustment of the hand(s), such as shown in FIGS. 7-10.

It should be understood that these operations do not have to be performed in the precise order described. Rather, various steps can be handled in a different order or simultaneously, and steps may also be added or omitted.

Depending on the specific arrangement, an emissive display, such as an OLED screen, may be employed instead of a non-emissive display.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A hybrid smartwatch to provide mechanical expressivity to a user, the hybrid smartwatch comprising:

a user interface subsystem including a digital graphical display and a mechanical movement having watch hands, the watch hands being arranged along a face of the hybrid smartwatch;

a mechanical movement control subsystem operatively coupled to the watch hands, the mechanical movement control subsystem configured to adjust the watch hands in one or both of clockwise and counterclockwise directions; and one or more processors operatively coupled to the digital graphical display and the mechanical movement control subsystem, the one or more processors being configured to:

select an information hiding visualization to be presented to a user using the watch hands, the information hiding visualization providing a predetermined adjustment of the watch hands;

determine whether to concurrently present visual information on the digital graphical display along with the adjustment of the watch hands, wherein the visual information is a notification to the user;

instruct the mechanical movement control subsystem to adjust the watch hands to provide the information hiding visualization by arranging a first of the watch hands at a particular location along the watch face, and adjusting a second of the watch hands by moving the second watch hand towards and away from the first watch hand, wherein with each movement of the second watch hand towards the first watch hand the notification is reduced in size; and upon a determination to concurrently present the visual information on the digital graphical display, cause the digital graphical display to present the visual information contemporaneously with the adjustment of the watch hands.

2. The hybrid smartwatch of claim 1, wherein the one or more processors are configured to select the information hiding visualization based on one or more identified items of information to be provided to the user.

3. The hybrid smartwatch of claim 1, wherein the mechanical movement control subsystem includes a plurality of actuators, each actuator configured to rotate a given one of the watch hands.

4. The hybrid smartwatch of claim 3, wherein the digital graphical display comprises a non-emissive display.

5. The hybrid smartwatch of claim 1, wherein each movement of the second watch hand takes 0.25-2.0 seconds.

6. The hybrid smartwatch of claim 1, wherein a first movement of the second watch hand moves a first amount and a second movement of the second watch hand moves a second amount, the second amount being smaller than the first amount.

7. A method of providing mechanical expressivity to a user with a hybrid smartwatch, the hybrid smartwatch including a digital graphical display and watch hands arranged along a face of the hybrid smartwatch, the method comprising:

selecting, by one or more processors, an information hiding visualization to be presented to a user using the watch hands, the information hiding visualization providing a predetermined adjustment of the watch hands;

determining, by the one or more processors, whether to concurrently present visual information on the digital graphical display along with the adjustment of the one or more watch hands, wherein the visual information is a notification to the user;

instructing, by the one or more processors, a mechanical movement control subsystem of the hybrid smartwatch to adjust the watch hands to provide the information hiding visualization by arranging a first of the watch hands at a particular location along the watch face, and adjusting a second of the watch hands by moving the second watch hand towards and away from the first watch hand, wherein with each movement of the second watch hand towards the first watch hand the notification is reduced in size; and upon a determination to concurrently present the visual information on the digital graphical display, the one or more processors causing the digital graphical display to present the visual information contemporaneously with the adjustment of the watch hands.

8. The method of claim 7, wherein the information hiding visualization is selected based on one or more identified items of information to be provided to the user.

9. The method of claim 7, wherein each movement of the second watch hand takes 0.25-2.0 seconds.

10. The method of claim 7, wherein a first movement of the second watch hand moves a first amount and a second movement of the second watch hand moves a second amount, the second amount being smaller than the first amount.

11. A hybrid smartwatch to provide mechanical expressivity to a user, the hybrid smartwatch comprising:

a user interface subsystem including a digital graphical display and a mechanical movement having watch hands, the watch hands being arranged along a face of the hybrid smartwatch;

a mechanical movement control subsystem operatively coupled to the watch hands, the mechanical movement control subsystem configured to adjust the watch hands in one or both of clockwise and counterclockwise directions; and one or more processors operatively coupled to the digital graphical display and the mechanical movement control subsystem, the one or more processors being configured to:

select an information revealing visualization to be presented to a user using the watch hands, the information revealing visualization providing a predetermined adjustment of the watch hands;

determine whether to concurrently present visual information on the digital graphical display along with the adjustment of the watch hands, wherein the visual information is a notification to the user;

instruct the mechanical movement control subsystem to adjust the watch hands to provide the information revealing visualization by arranging a first of the watch hands at a particular location along the watch face, and adjusting a second of the watch hands by moving the second watch hand towards and away from the first watch hand, wherein with each movement of the second watch hand away from the first watch hand the notification increases in size; and upon a determination to concurrently present the visual information on the digital graphical display, cause the digital graphical display to present the visual information contemporaneously with the adjustment of the watch hands.

12. The hybrid smartwatch of claim 11, wherein the one or more processors are configured to select the information revealing visualization based on one or more identified items of information to be provided to the user.

13. The hybrid smartwatch of claim 11, wherein the mechanical movement control subsystem includes a plurality of actuators, each actuator configured to rotate a given one of the watch hands.

14. The hybrid smartwatch of claim 13, wherein the digital graphical display comprises a non-emissive display.

15. The hybrid smartwatch of claim 11, wherein each movement of the second watch and takes 0.25-2.0 seconds.

16. The hybrid smartwatch of claim 11, wherein a first movement of the second watch hand moves a first amount and a second movement of the second watch hand moves a second amount, the second amount being larger than the first amount.

17. A method of providing mechanical expressivity to a user with a hybrid smartwatch, the hybrid smartwatch including a digital graphical display and watch hands arranged along a face of the hybrid smartwatch, the method comprising:

selecting, by one or more processors, an revealing hiding visualization to be presented to a user using the watch hands, the information revealing visualization providing a predetermined adjustment of the watch hands;

determining, by the one or more processors, whether to concurrently present visual information on the digital graphical display along with the adjustment of the watch hands, wherein the visual information is a notification to the user;

instructing, by the one or more processors, a mechanical movement control subsystem of the hybrid smartwatch to adjust the watch hands to provide the information revealing visualization by arranging a first of the watch hands at a particular location along the watch face, and adjusting a second of the watch hands by moving the second watch hand towards and away from the first watch hand, wherein with each movement of the second watch hand away from the first watch hand the notification increases in size; and upon a determination to concurrently present the visual information on the digital graphical display, the one or more processors causing the digital graphical display to present the visual information contemporaneously with the adjustment of the watch hands.

18. The method of claim 17, wherein the information revealing visualization is selected based on one or more identified items of information to be provided to the user.

19. The method of claim 17, wherein each movement of the second watch and takes 0.25-2.0 seconds.

20. The method of claim 17, wherein a first movement of the second watch hand moves a first amount and a second movement of the second watch hand moves a second amount, the second amount being larger than the first amount.

* * * * *